US005337484A

United States Patent [19]

Cardon

[11] Patent Number: 5,337,484

[45] Date of Patent: Aug. 16, 1994

[54] SCRIPTWRITING GUIDANCE DEVICE

[76] Inventor: Hugh L. Cardon, 300 Riverside Dr., New York, N.Y. 10025

[21] Appl. No.: 103,984

[22] Filed: Aug. 10, 1993

[51] Int. Cl.[5] ..... B43L 13/02

[52] U.S. Cl. ..... 33/41.2; 33/566; 434/117

[58] Field of Search ..... 33/41.2, 447, 562, 564, 33/566, 443, 477, DIG. 9, 430, 434, 467; 434/117

[56] References Cited

U.S. PATENT DOCUMENTS

| | | | |
|---|---|---|---|
| 980,623 | 1/1911 | Frost | 434/117 |
| 2,562,479 | 7/1951 | Spikes | 434/117 X |
| 3,193,947 | 7/1965 | Dean | 434/117 |
| 3,899,839 | 8/1975 | Essmann | 434/117 |
| 3,949,492 | 4/1976 | Less | 434/117 |
| 4,223,447 | 9/1980 | Greenlees | 434/117 X |
| 4,364,184 | 12/1982 | Dowzall | 33/447 |
| 4,679,328 | 7/1987 | Saad | 33/447 |

*Primary Examiner*—William A. Cuchlinski, Jr.
*Assistant Examiner*—Alvin Wirthlin
*Attorney, Agent, or Firm*—Michael Ebert

[57] ABSTRACT

A scriptwriting guidance device for use by individuals who are visually or otherwise impaired, the device acting to guide the writer's pen or other writing implement along a straight, horizontal path across a writing surface to form complete letters and other characters without interference from the device. The device includes a backboard having a shaft mounted for rotation adjacent one side edge thereof. Slidable along the shaft in incremental steps is a slide from whereby is cantilevered a guide element formed by a rectangular frame that overlies a paper sheet lying on the backboard. Disposed within the window of the frame is a rectangular template of smaller dimensions, the template having a narrow slot that defines a straight, horizontal path. The opposite ends of the template are coupled by springs to the corresponding ends of the frame whereby the template effectively floats within the window and is free to shift laterally. The writer's implement is inserted through the slot to engage the paper sheet, and as the writer forms letters, numbers and other characters along the straight path, the template shifts laterally within the window to permit completion of these characters.

10 Claims, 3 Drawing Sheets

SCRIPTWRITING GUIDANCE DEVICE

BACKGROUND OF INVENTION

1. Field of Invention

This invention relates generally to writing guides adapted to assist individuals who are visually or otherwise impaired to write in a legible manner, and more particularly to a scriptwriting guidance device to guide a writer's pen or other writing implement along a straight, horizontal path across a writing surface to form letters and other characters without interference from the device.

2. Status of Prior Art

A person having normal vision who is free of any neuromuscular disability is able to write in a legible manner along a straight, horizontal path across a paper sheet or other writing surface. In this age of personal computers, writing is no longer limited to paper or similar writing surfaces, for pen-based or so-called notepad computers are now available in which data is entered not by way of a keyboard but by means of an electronic stylus with which the user of the computer writes on an illuminated surface responsive to the stylus to digitize the script written thereby.

But individuals who are blind or visually impared, or who suffer from a neuromuscular disability that makes it difficult to write, cannot write legibly along a straight, horizontal path on a writing surface. Thus a blind person, while he can manipulate a writing implement cannot see the characters he is forming on the writing surface, nor can he see whether these characters are being written along a straight, horizontal path across the surface. While some writing paper is ruled with parallel straight lines to define writing paths across the paper sheet, a person with normal vision can usually write legibly on unruled paper. But those who are visually or otherwise impaired cannot do so.

In order to make it possible for hadicapped individuals who are incapable of writing legibly along straight, horizontal paths on a writing surface to be able to do so, the prior art discloses various forms of writing guides for this purpose.

Thus the Marks U.S. Pat. Nó. 2,530,437 shows a clip board to accommodate a paper writing sheet, a pair of tracks being mounted on opposite side margins of the board. Bridging these tracks is a rectangular frame whose ends are joined to slides that ride on the tracks. Each track is provided with a row of equi-spaced holes, and each slide is provided with a spring-biased plunger that is insertable in a selected track hole so that the frame is movable in a stepwise manner down the board.

The window of the Marks frame which overlies the paper sheet, serves as a writing slot to restrict movement of the writing implement to a corresponding path across the paper. The writer who uses the Marks guide writes within the confines of the window of the frame, and upon the completion of each line of writing, the frame is advanced one step down to a position parallel to the written line above, and the writer then proceeds to write the next line.

As pointed out in U.S. Pat. Nos. 3,899,839 to Essmann and 4,223,447, to Greenlees when a blind person writes within a narrow guide slot having rigid sides or within a slot defined by a pair of spaced rigid bars, the fixed dimensions of the slot interfere with those writing movements necessary to complete the letters, numbers and other characters of the written script. The rigid upper and lower edges of the slot cause the top and bottom of these characters to be chopped off. Thus when writing the letter "d" within a rigid writing slot, the upper edge of the slot will chop off the vertical section of this letter, and the letter will then appear as an "o." And in writing the letter "h," the upper edge of the slot will decapitate the top vertical section of this letter which will then appear as an "n." In writing letters such as "g," "q" and "y" within a rigid narrow slot, the rigid bottom edge of this slot will chop off the bottom tails of these letters. Writing, whether carried out in block letters or in a cursive style such as writing using upper case and lower case letters, numbers, symbols and other characters, in order to be fully legible, the characters cannot be truncated but must be completely formed.

Essmann's solution to this problem is to provide a writing guide having a slot defined by parallel bars that are pivotally mounted at their ends and spring biased, the guide bars yielding when engaged by the writing implement to permit completion of the written characters. Greenlees' solution is to provide a writing slot defined by a pair of flexible strings which when engaged by the writing implement are deflected to permit completion of the characters.

In the Spikes U.S. Pat. No. 2,562,479, a writing guide for the blind includes upper and lower cross bars that are spring biased to yield to pressure applied thereto by a writing implement to permit the completion of characters.

This arrangement, according to Spikes, permits a blind person to write legibly and to ensure that all written lines will be parallel to each other and evenly spaced. A writing guide arrangement for the blind or visually impaired similar to that in Spikes is disclosed in the Frost U.S. Pat. No. 980,623.

The above-described prior art writing guide structures are relatively complex and costly to manufacture, for the guide element which defines a writing slot for the writing implement is supported by a pair of tracks or similar means mounted on opposing side margins of a backboard, with slides being provided on both tracks to permit indexing of the guide element along the tracks. The paper sheet which must be placed on the backboard has to slip in and fit between the tracks. This limits the size of the paper that can be used and also makes it somewhat difficult for a visually impaired individual to place a paper sheet on the backboard or to remove it therefrom.

SUMMARY OF INVENTION

In view of the foregoing, the main object of this invention is to provide for use by individuals who are visually or otherwise impaired a scriptwriting guidance device which acts to guide the writer's pen or other writing implement along a straight, horizontal path across a writing surface to form complete letters or other characters without interference from the device.

More particularly, an object of this invention is to provide a device of the above type which is portable, simple and of inexpensive mechanical design so that the device can be mass-produced and sold at a relatively low price.

A significant feature of a device in accordance with the invention is that it provides a flexible, tactile and responsive guide for common cursive and other manuscript styles of writing, while maintaining the written script within a straight, horizontal path. For children with impaired abilities to write legibly and in a straight line, the device facilitates the actual handwriting process.

Also an object of this invention is to provide a scriptwriting guidance device in which a rotatable shaft is mounted on the left side margin of a backboard or other supportiing surface, a slide movable in incremental steps along the shaft having a writing guide element cantilevered therefrom, whereby the guide element may be swung up from the backboard to permit a paper sheet to be placed on the backboard or removed therefrom, and then swung down to overlie the paper sheet.

While a guidance device in accordance with the invention will be described in an embodiment having a clip board or backboard to accommodate a sheet of paper to be written on, it is to be understood that a backboard is not essential to the inventive concept, for the guidance device may be applied to enter data on a notepad of a pen-type computer, and used in conjunction with an electronic stylus.

Briefly stated, these objects are attained in a scriptwriting guidance device for use by individuals who are visually or otherwise impaired, the device acting to guide the writer's pen or other writing implement along a straight, horizontal path across a writing surface to form complete letters and other characters without interference from the device. The device includes a backboard having a shaft mounted for rotation adjacent one side edge thereof. Slidable along the shaft in incremental steps is a slide from whereby is cantilevered a guide element formed by a rectangular frame that overlies a paper sheet lying on the backboard. Disposed within the window of the frame is a rectangular template of smaller dimensions, the template having a narrow slot that defines a straight, horizontal path. The opposite ends of the template are coupled by springs to the corresponding ends of the frame whereby the template effectively floats within the window and is free to shift laterally. The writer's implement is inserted through the slot to engage the paper sheet, and as the writer forms letters, numbers and other characters along the straight path, the template shifts laterally within the window to permit completion of these characters.

BRIEF DESCRIPTION OF DRAWINGS

For a better understanding of the invention, as well as further objects and features thereof, reference is made to the annexed drawings having the following figures.

DETAILED DESCRIPTION OF INVENTION

Figure 1:
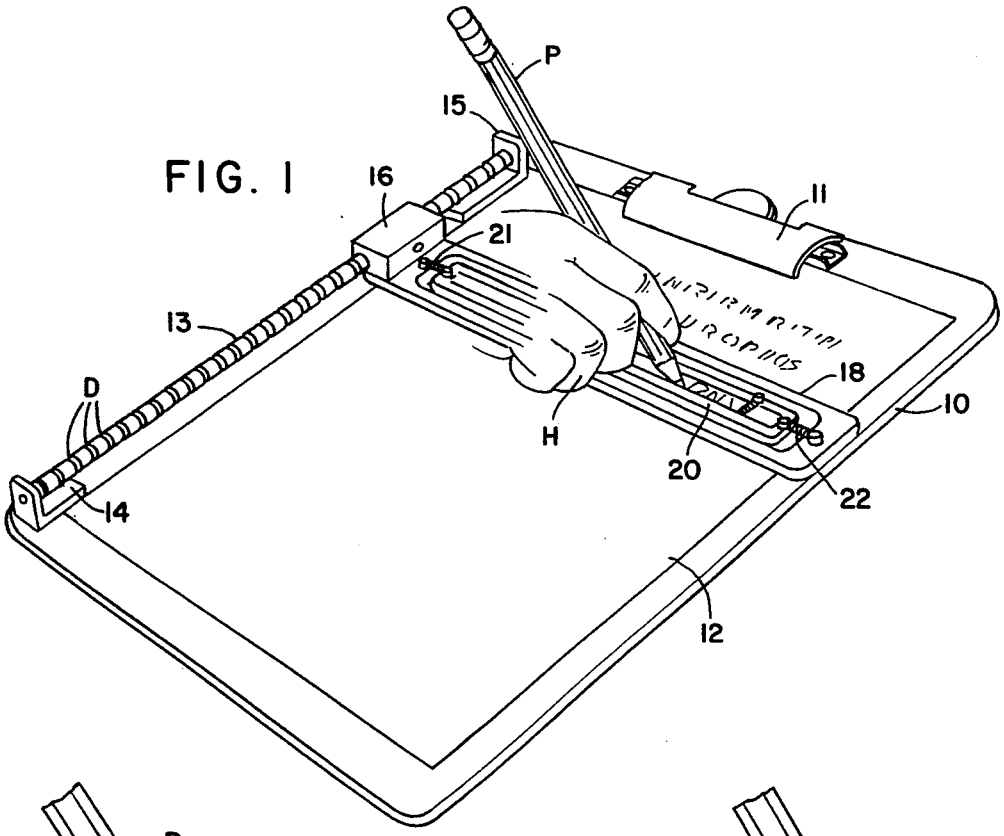
FIG. 1 is a perspective view of a preferred embodiment of a scriptwriting guidance device according to the invention.
Figure 2:
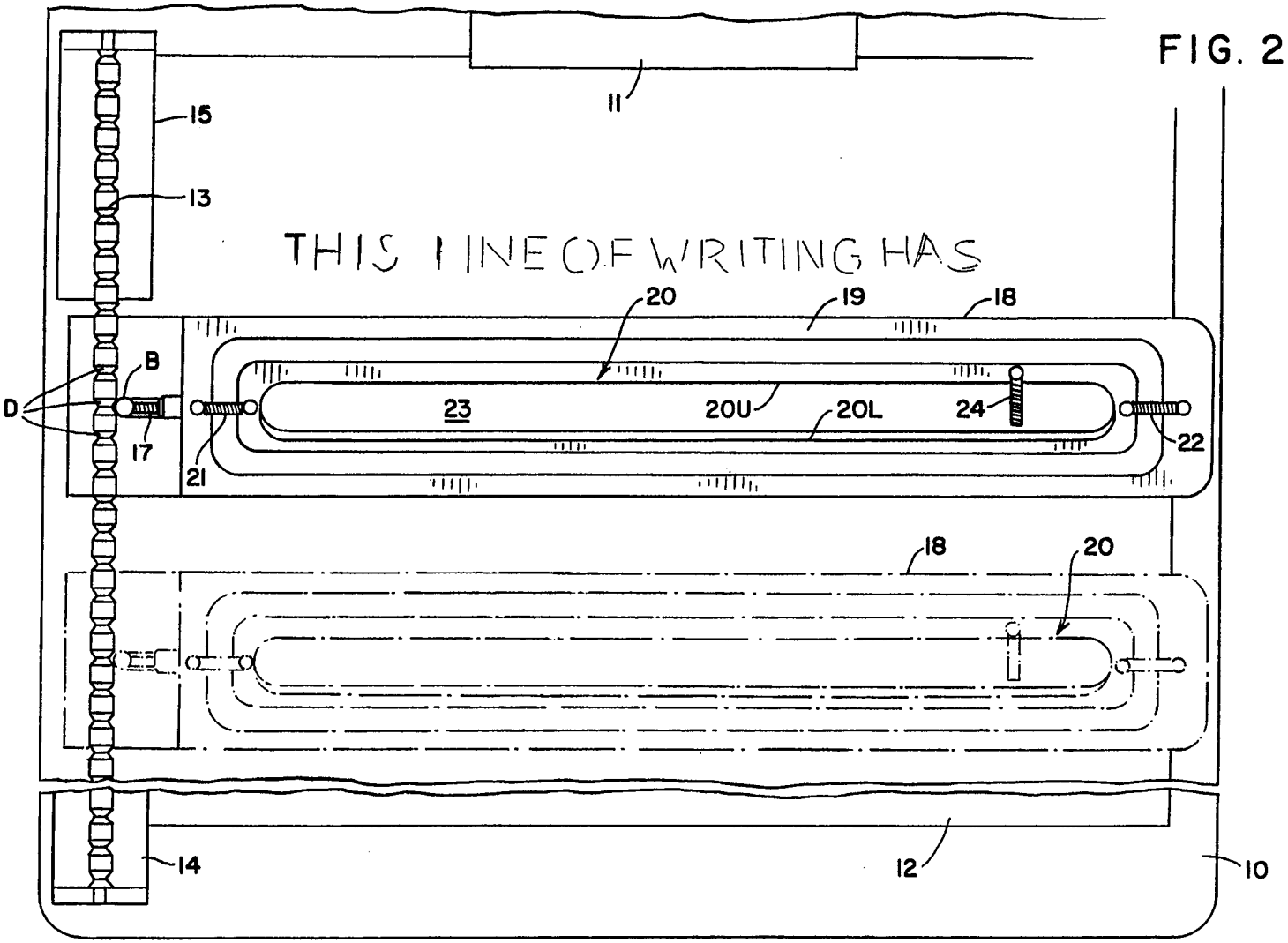
FIG. 2 is a top view of the device illustrating how the guide element is advanced incremetally.

Referring now to FIGS. 1 and 2, which illustrate a preferred embodiment of a scriptwriting guidance device in accordance with the invention for use by an individual who is visually or otherwise impaired, the device includes a clip board 10 whose upper end is provided with a retractable clip 11 to retain a paper sheet 12 on the board. The hand H of a writer is shown writing on paper sheet with a pencil P. However, in practice a pen or other suitable writing implement may be used.

Mounted on the left margin of board 10 is a rotatable shaft 13 whose ends are supported in bearing holes formed in upper and lower brackets 14 and 15 attached to the board. Machined or otherwise formed in shaft 13 is a series of equi-spaced circular detent grooves D which extend along the length of the shaft. Slidable along the shaft is a block-shaped slide 16. As shown in FIG. 2, slide 16 is provided with an internal bore having a detent ball B therein which is urged by a compressible spring 17 into an adjacent detent groove D in shaft 13.

Slide 16 can therefore be advanced in incremented steps and thereby indexed along shaft 13, the spacing between the detent grooves D determining the size of the steps; and the detent ball B maintaining the slide position at each step.

Cantilevered from slide 16 is a guide element formed by a rectangular frame 18 whose length is such when the frame overlies paper sheet 12 it extends to the right side edge of clip board 10. The corners at the right end of frame 18 are rounded so as to avoid sharp edges that may inflict injury on a visually impaired individual using the device who cannot see the frame, though he can feel it.

Frame 18 is provided with a rectangular opening or window 19 within which is positioned a rectangular template 20 of somewhat smaller dimensions than that of the window. Template 20 is supported within window 19 of the frame by a pair of helical springs 21 and 22, spring 21 being connected between the left end of the template and the same end of the frame, spring 22 being connected between the right end of the template and the same end of the frame.

The rectangular opening of the template 20 defines a narrow slot 23 creating a straight, horizontal writing path creating at its lower edge 20L a horizontal line across the surface of the paper sheet underlying the slot. Thus when the writer using pencil P which is inserted through slot 23 to engage the surface of paper sheet, writes across the paper sheet, his writing is confined to the horizontal path created by the slot. Upon completion of a line of writing, the guide element is then advanced down the board to place the slot at a position parallel to the written line above, as shown in FIG. 2, so that the writer can write the next line of script.

In order to notify the visually impaired writer that he is approaching the end of the line, a third helical spring 24 is provided which is cantilevered from the upper edge 20U of the template and extends into the slot 23 at right angles to the other springs. When the writer with his pencil operating within slot 23 strikes spring 24, he then knows he is close to the right end of the slot.

In its static state as shown in FIG. 2, template 20 is centered within the window 19 of frame 18, and the springs 21 and 22 which support the template extend along the center horizontal axis of the template. Because it is spring mounted, template 20 effectively floats within window 19 of frame 18 and is free to shift laterally. In the course of writing within slot 23, the writing implement P engages the upper horizontal edge 20U of the template or its lower horizontal edge 20L in order to complete the script characters being written.

Figure 6:
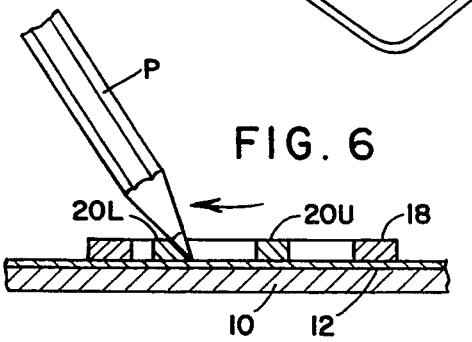
FIG. 6 shows the template being displaced laterally in the frame of the guide element when the lower edge of the template is engaged by a pencil.
Figure 7:
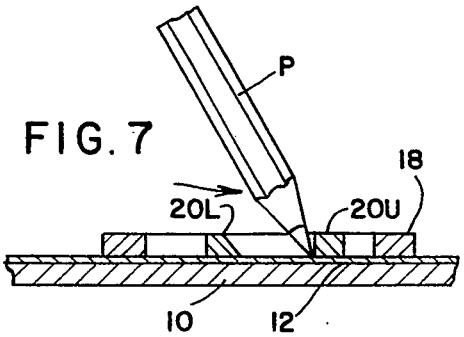
FIG. 7 shows how the template is displaced when its upper edge is engaged by the pencil.
Figure 5:
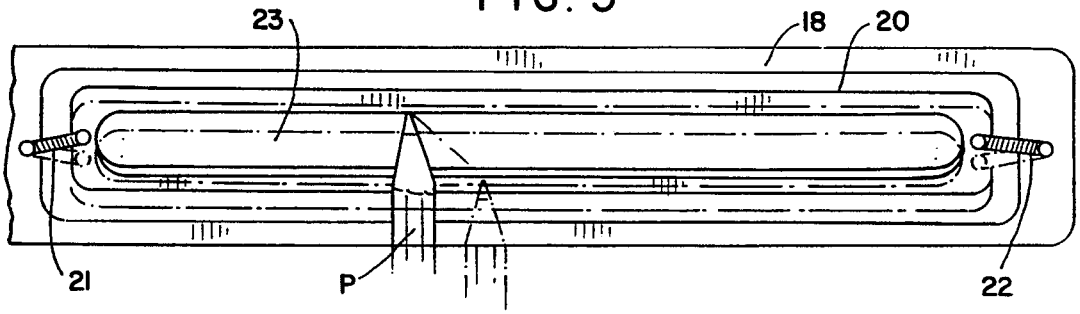
FIG. 5 is a plan view of the guide element, showing a pencil in engagement with the upper edge of the guide element, and also a pencil engaging the lower edge.

FIG. 5 shows pencil P when it engages upper edge 20U of the template and when it engages the lower edge 20L. As shown in FIG. 6, when the point of pencil P pushes against the lower edge 20L of the template to complete a character, the template is then displaced laterally toward the lower edge of frame 18 to permit the pencil to complete the formation of a character. And when as shown in FIG. 7, the pencil pushes against the upper edge 20U of the template, the template is then shifted toward the upper edge of frame 18 to permit the pencil to complete the formation of the character.

Figure 3:
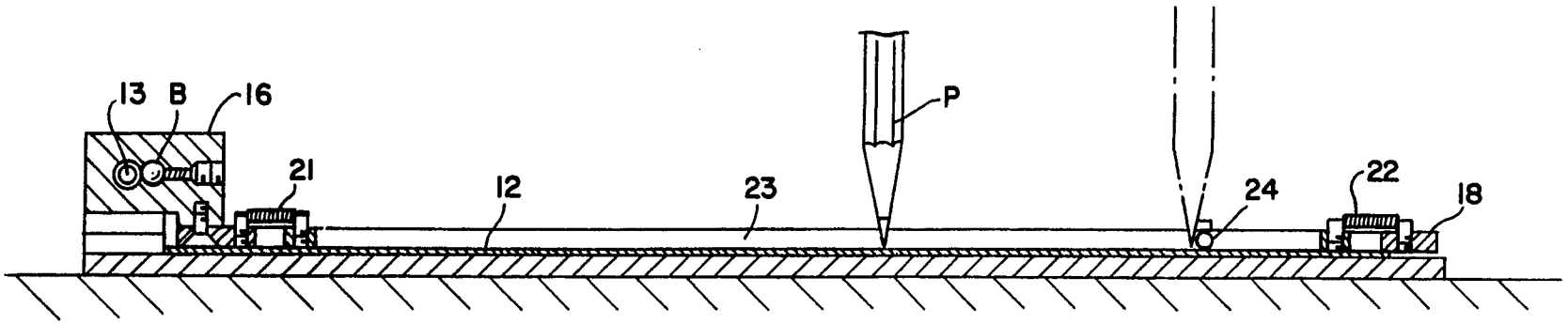
FIG. 3 is a transverse section taken through the device showing the relationship of a writing implement to the structure of the guide element, when it is in its operative position.
Figure 4:
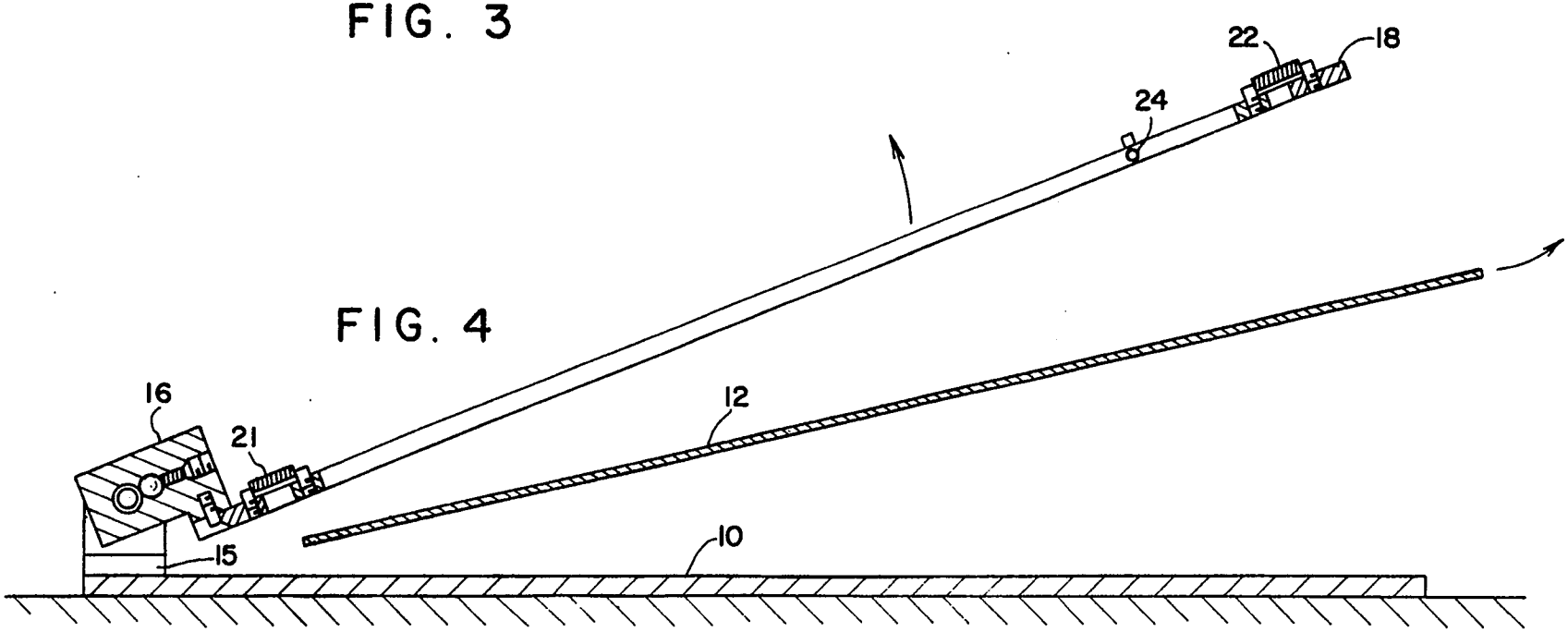
FIG. 4 shows how the guide element is swung up from the clip board to admit a paper sheet.

The manner in which a paper sheet 12 is laid down on clip board 10 is illustrated in FIGS. 3 and 4. Because the guide element formed by frame 18 is cantilevered from slide 16 which is slidable on shaft 13 which has a circular cross section, the frame may be swung up about shaft 13 as shown in FIG. 4 to admit a paper sheet 12 between the frame and clip board 10. The sheet is placed on the surface of the clip board and the frame is then swung down so that it then overlies the paper sheet to provide a writing slot as a guide for pencil P, as shown in FIG. 3. To remove the paper sheet after writing thereon is completed, one has only to again swing open the guide element.

All components of the device may be fabricated of high strength metal, such as stainless steel, or they can be made in whole or in part of high-strength synthetic plastic materials, such as polypropylene.

In practice, in order to write on a postcard laid down on the clip board, one may place under clip 11 the upperarm of a right angle jig which serves to engage the left upper corner of the postcard to maintain it in its proper position relative to the guide slot. And as pointed out above, it is not necessary to use a backboard or a clip board, for when the device is to be used by one who is visually impaired for writing with an electronic stylus on a computer notepad, the shaft of the device may be mounted for rotation on the notepad by means of suction cups or other means, so that the guide element mounted on the shaft then directly overlies the notepad to provide a writing slot for the stylus.

While there has been shown a preferred embodiment of a scriptwriting guidance device, it is to be understood that many changes and modifications may be made thereon without departing from the spirit of the invention.

What I claim is:

1. A scriptwriting guidance device to assist a visually or otherwise impaired individual in writing along a straight, horizontal path across a writing surface with a writing implement and to complete the formation of letters and other characters without interference from the device, said device comprising:

A. a backboard on which is placeable a paper sheet to be written on by the individual;

B. a shaft mounted for rotation on a side margin of the backboard;

C. a slide slidable along the shaft; and

D. a guide element cantilevered from the slide and extending across the backboard, said element being formed by a frame having a rectangular window defining a plurality of sides and ends and having predetermined side and end dimensions, said element being adapted to overly the paper sheet, and a rectangular template having smaller side and end dimensions than those of the window and being spring-supported within the window so that said template effectively floats therein and is free to move towards said sides and said ends within the window, said template having a rectangular slot therein defining a straight, horizontal path across the paper sheet whereby the individual writing with said implement within the slot displaces the template with the implement to complete the formation of letters and other characters.

2. A device as set forth in claim 1, in which the backboard is provided with a clip to hold the paper in place.

3. A device as set forth in claim 1, in which the shaft is supported at either end by a bracket attached to the backboard and having a bearing hole.

4. A device as set forth in claim 1, in which the template is supported within the window by a first helical spring connected between one end of the template and the corresponding end of the frame, and a second helical spring connected between the other end of the template and the corresponding end of the frame.

5. A device as set forth in claim 4, further including a third helical spring cantilevered at one end from the upper edge of the template and extending into the slot adjacent one end thereof, whereby when the third spring is struck by the writing implement, it notifies the individual that he is close to the end of the writing line.

6. A device as set forth in claim 1, in which the shaft has formed therein along its length a series of equispaced circular grooves which are engaged by a detent ball carried by the slide whereby the slide may be advanced in a step-wise manner on the shaft.

7. A device as set forth in claim 1, in which the guide element cantilevered from the slide mounted on the rotatable shaft can be swung up to admit a paper sheet and then swung down to overlie the paper sheet lying on the backboard.

8. A scriptwriting guidance device to assist a visually impaired individual in writing along a straight, horizontal line across a writing surface with a writing implement, said device comprising a guide element formed by a frame having a rectangular window defining a plurality of sides and ends said element being adapted to overly the surface having predetermined side and end dimensions and a rectangular template having smaller side and end dimensions than those of the window supported within he window by springs whereby the template effectively floats within the window and is free to move towards said sides and said ends within the window, said template having a rectangular slot to receive the implement and defining a rectangular writing path across the writing surface, said implement, when manipulated by the individual, acting to displace the template to permit the formation of script or other characters.

9. A device as set forth in claim 8, in which the template is formed of high-strength, synthetic plastic material.

10. A device as set forth in claim 9, in which the material is polypropylene.

* * * * *